United States Patent [19]

Reinehr et al.

[11] Patent Number: 4,505,870

[45] Date of Patent: Mar. 19, 1985

[54] PREPARATION OF LOW RESIDUAL SOLVENT CONTENT POLYACRYLONITRILE FILAMENTS

[75] Inventors: Ulrich Reinehr; Toni Herbertz; Hermann-Josef Jungverdorben, all of Dormagen; Hans Uhlemann, Solingen, all of Fed. Rep. of Germany

[73] Assignee: Bayer Aktiengesellschaft, Leverkusen, Fed. Rep. of Germany

[21] Appl. No.: 505,514

[22] Filed: Jun. 17, 1983

[30] Foreign Application Priority Data

Jul. 6, 1982 [DE] Fed. Rep. of Germany ..... 3225267

[51] Int. Cl.[3] ..... D01F 6/18

[52] U.S. Cl. ..... 264/206; 264/234

[58] Field of Search ..... 264/206, 234

[56] References Cited

U.S. PATENT DOCUMENTS

| | | | |
|---|---|---|---|
| 2,417,294 | 3/1947 | D'Alelio | 264/206 |
| 2,811,409 | 10/1957 | Clapp et al. | 264/206 |
| 2,851,435 | 9/1958 | Pirot | 264/206 |
| 3,739,054 | 6/1973 | Wieden et al. | 264/206 |
| 4,140,844 | 2/1979 | Lohwasser | 264/206 |

FOREIGN PATENT DOCUMENTS

| | | | |
|---|---|---|---|
| 41-21578 | 12/1966 | Japan | 264/206 |

*Primary Examiner*—Donald Czaja
*Assistant Examiner*—Hubert C. Lorin
*Attorney, Agent, or Firm*—Sprung, Horn, Kramer & Woods

[57] ABSTRACT

Polyacrylonitrile filaments having a residual solvent content of less than 5% by weight and a total linear density of over 100,000 dtex can be prepared without contact with an extracting agent for the spinning solvent by a process in which (a) the spinning solution spun has a viscosity at 100° C. of 10 to 60 falling-ball seconds, (b) the filaments are treated while still hot, directly at the end of the spinning cell, inside it or immediately outside the end of the cell, with a spin-finish which contains a lubricant and an antistat and which gives the filaments a moisture content of at most 10% by weight, relative to the solids content of the fibre, and (c) the filaments are immediately exposed to a heat treatment without cooling down first.

3 Claims, No Drawings

PREPARATION OF LOW RESIDUAL SOLVENT CONTENT POLYACRYLONITRILE FILAMENTS

The invention relates to a process for preparing low residual solvent content polyacrylonitrile filaments with at least 45% by weight of acrylonitrile units by a dry-spinning method where the filaments do not come into contact with an extracting agent for the spinning solvent. Low residual solvent content spun material prepared in this way can, for example, be directly stretched, crimped, relaxed and cut in one completely uninterrupted operation, and thus be converted into finished fibres in a continuous manner.

Freshly dry-spun acrylic fibres customarily have a solvent content of about 15–50% by weight. This residual solvent content, the solvent being for example dimethylformamide, is virtually removed quantitatively in a wash before, during or even after the stretch.

The solvent-containing wash waters are worked up by distillation for economic and ecological reasons. U.S. Pat. No. 2,811,409 describes a process for the continuous preparation of acrylic filaments having low residual solvent contents in spinning jets having a small number of holes, at most 200, and very long spinning cells, of up to 9 m, with several hot-air inlets by using high viscosity acrylonitrile copolymers.

The examples show further that spinning is carried out through spinning jets having extremely fine bores, namely which have a diameter of, for example, 0.08 mm, which leads to extremely low draw-downs. These low draw-downs are evidently necessary to prevent the high viscosities of the spinning solutions and the high energy stresses in the spinning cell from causing breaks and slips on the bobbins.

This process is merely capable of producing acrylic silks having low tow linear densities.

This U.S. patent process, moreover, gives high static charges on the filaments when residual solvent (DMF) contents are less than about 5% by weight.

It is an object of the present invention to provide a dry-spinning process for preparing low residual solvent content polyacrylonitrile filaments having high total linear densities of 100,000 dtex or more which works without an extracting agent for the spinning solvent and avoids static charges.

A skilled worker will know that in dry-spinning the residual solvent content in the spun material can be controlled via various parameters. Suitable control variables are the temperatures of the cell and of the spinning air, the air rate and the dwell time in the spinning cell. The latter can in turn be affected by the geometry of the spinning cell and the spin speed. However, the object defined above cannot be achieved solely on the basis of existing knowledge.

It has now been found, surprisingly, that this object can be achieved if a spinning solution of a certain viscosity is used, the spun material is wetted while still hot directly at the end of the spinning cell, inside it or immediately outside the end of the cell, with a spin-finish which contains a lubricant and an antistat and which gives the filaments a moisture content (water) of at most 10%, relative to the solids content of the fibre, and is directly exposed to a heat treatment without cooling down first, for example by passing the spun material through a tube through which hot air, saturated steam or superheated steam is passed countercurrent to the moving filaments, or by passing the sheet of filaments over heated enclosed calender bowls fitted with an exhaust for the solvent residues.

In the case of contact heat or hot air, a particularly suitable temperature for the heating medium is between 150° and 300° C. with treatment times of 5 seconds to 3 minutes; in the case of saturated steam, the temperature of the heating medium is preferably 103° to 120° C. and the treatment time is 5 seconds to 5 minutes; and in the case of superheated steam, the temperatures preferably are between 120° and 180° C. and the treatment times between 5 seconds and 5 minutes.

Other suitable means with which to carry out the heat treatment are a straight or curved hot bar and heated godets.

The invention therefore relates to a dry-spinning process for preparing polyacrylonitrile filaments containing at least 45% by weight of acrylonitrile units and having a residual solvent content of less than 5% by weight and a total linear density of over 100,000 dtex without contact with an extracting agent for the spinning solvent by spinning a spinning solution of the polymer, characterised in that (a) the spinning solution spun has a viscosity at 100° C. of 10 to 60 falling-ball seconds, (b) the filaments are treated while still hot, directly at the end of the spinning cell, inside it or immediately outside the end of the cell, with a spin-finish which contains a lubricant and an antistat and which gives the filaments a moisture content of at most 10% by weight, relative to the solids content of the fibre, and (c) the filaments are immediately exposed to a heat treatment without cooling down first.

The draw-down of the process is preferably greater than 2. In a particularly preferred embodiment, the spining solution has at 100° C. a viscosity of 15 to 50 falling-ball seconds.

The draw-down V is defined as the ratio of take-off speed A to the extrusion speed S:

$$V = \frac{A\ (\text{m/min})}{S\ (\text{m/min})}$$

The extrusion speed S is given by:

$$S = \frac{4 \times F_2}{Z \times d^2 \times \pi \times 100}$$

wherin

F=delivery rate ($cm^3$/min)

Z=number of holes per spinning jet d=jet hole diameter (cm)

Compare Faserforschung 16 (1965), No. 9, page 465. The delivery rate (pump volume times number of revolutions per minute) is given by the following equation:

$$G_{ST} = \frac{P \times U \times K \times 0{,}94 \times 10\,000}{A \times 100}$$

where $G_{ST}$=total linear density (dtex=9/10,000 m)

P=pump volume ($cm^3$)

U=number of revolutions per minute ($min^{-1}$)

K=spinning solution concentration g/$cm^3$)

A=take-off speed (m/min)

Suitable for use as acrylonitrile polymers are all acrylonitrile homopolymers and copolymers which can be spun into so-called acrylic fibres or modacrylic fibres, preferably acrylonitrile copolymers containing at least 85% by weight of acrylonitrile units. Homopolymers and terpolymers consisting of 89 to 95% by weight of acrylonitrile, 4 to 10% by weight of a nonionic comonomer, for example ethyl acrylate, methyl methacrylate or vinyl acetate, and 0.5 to 3% by weight of an ionic comonomer, for example methallyl sulphonate or styrene sulphonate, are particularly preferred. The polymers are known.

The spin-finish can also contain water as a component. However, spin-finish mixtures having a moisture content of greater than 50% are not preferred, since the sheet of filaments cools down too much before the subsequent aftertreatment steps, such as stretching, crimping and the like, and it is no longer ensured that the spun material becomes evenly hot before the stretch.

Examples of suitable lubricants are glycols, their derivatives, silicone oils, ethoxylated fatty acids, alcohols, esters, amides, alkyl ether sulphates and mixtures thereof.

Suitable antistats are the customary cationic, anionic or nonionic compounds, such as long-chain, ethoxylated, sulphated and neutralised alcohols.

The spin-finish is advantageously brought into contact with the individual spinning cell tows at elevated temperatures of 50°–90° C. to prevent the hot sheet of filaments from cooling down. The individual tows spun in a machine which has, for example, 20 spinning cells and having a total linear density of 100,000 dtex or more are treated with spin-finish in this way and, on leaving the heat-setting unit, combined into one tow, which is directly passed on for further aftertreatment, which comprises, for example, the steps stretching, crimping, shrinking and cutting.

A great advantage of the process of the invention is that low residual solvent content filaments prepared in this way can be aftertreated in a completely uninterrupted continuous process to give finished acrylic fibres.

Another great advantage of the novel process for preparing low residual solvent content filaments is that dispensing with a wash has also eliminated the need for a drying unit. This cuts not only investment and maintenance costs but also, naturally, energy costs, markedly.

Spinning take-off speeds of up to 100 m/min are generally sufficient to keep the residual solvent content in the spun material clearly below 5% by weight.

The low residual solvent content spinning process of the invention can also be applied to jet-dyed spun material. The addition of dyestuffs or pigments to acrylonitrile polymer spinning solutions gives coloured spun material which can be processed into spun-dyed acrylic fibres.

The viscosity in falling-ball seconds, measured at 100° C., was determined in accordance with the method of K. Jost, Reologica Acta, volume 1 (1958), page 303. The following conversion rule applies: 1 falling-ball second equals 4.37 poise.

EXAMPLE 1

700 kg of dimethylformamide (DMF) are mixed in a vessel at room temperature with stirring with 300 kg of an acrylonitrile copolymer which consists of 93.6% of acrylonitrile, 5.7% of methyl acrylate and 0.7% of sodium methallyl sulphonate and which has a K value of 81. The suspension is pumped by a gear pump into a spinning vessel which is equipped with a stirrer. The suspension is then heated in a jacketed pipe with steam at 4.0 bar. The dwell time in the pipe is 5 minutes. The spinning solution, which at the pipe outlet has a temperature of 138° C. and a viscosity of 19 falling-ball seconds, measured at 100° C., is cooled ddwn to 90° C. on leaving the heating-up apparatus, filtered and directly passed into a spinning unit which has 20 spinning cells.

The spinning solution is dry-spun with a take-off speed of 50 m/min through a spinning jet which has 1,264 holes which have a diameter of 0.25 mm. The spinning solution is delivered to each spinning cell at a rate of 370.8 ccm/min. The cell temperature is 200° C., and the air temperature is 360° C. Air is blown through each cell at a rate of 40 $m^3/h$. The filaments, spun with a draw-down of 2.1, are wetted immediately on leaving the spinning cells, before entry into a downstream tube, with a warm lubricant- and antistat-containing low water content spin-finish at 80°–90° C. in such a way that the oil content of the filaments is 0.16% by weight and the antistat content is 0.04% by weight, relative to the solids content. The spin-finish is metered out via gear pumps. The horizontal tube which is downstream of the spinning machine and through which the sheet of filaments is passed is charged in countercurrent to the moving filaments with hot air at 300° C. to remove DMF. The dwell time of the filaments in the spinning cell and the tube supplied with hot air is about 18 seconds. Hot air is sent in countercurrent through the tube at a rate of 600 $m^3/h$.

The warm acrylic tow, which has a linear density of of 344,000 dtex, still has a residual solvent (DMF) content of 1.6% by weight. The tow can then be stretched, crimped, shrunk and cut into staple fibres in one uninterrupted operation.

EXAMPLE 2

An Example 1 spinning solution is spun into filaments and again wetted before entry into the downstream tube with a warm lubricant- and antistat-containing low water content spin-finish at 80°–90° C. Superheated steam at 110° C. is sent through the tube in countercurrent to the moving filaments to remove DMF. Steam is sent through the tube at a rate of 150 kg/h. The dwell time of the spun material in the spinning cells and the tube supplied with superheated steam is again about 18 seconds. The warm acrylic tow, which again has a linear density of 344,000 dtex, still has a residual solvent (DMF) content of 1.3% by weight. The tow can then be processed into finished staple fibres in one uninterrupted operation.

EXAMPLE 3

An Example 1 spinning solution is spun into filaments, but the take-off speed is 100 m/min and spinning solution is delivered to each spinning cell at a rate of 512 ccm/min. The filaments, spun with a draw-down of 3.0, are spin-finished immediately before leaving the spinning cells and before entry into the downstream tube and are then subjected in the tube, for DMF removal, to hot air at 300° C. in countercurrent to their direction of motion. The dwell time of the spun material in the spinning cells and the tube supplied with hot air is about 9 seconds. Hot air is sent in countercurrent through the tube at a rate of 800 $m^3/h$. The warm acrylic tow, which has a linear density of 265,500 dtex, still has a residual solvent (DMF) content of 2.2% by weight. The tow can then be directly processed into staple fibres in one uninterrupted operation.

EXAMPLE 4

A spinning solution was prepared and spun into filaments which were spin-finished, all three steps being carried out under the conditions given in Example 1.

The filament bundle is then passed over 13 electrically heated calender rolls at 195° C. which have a diameter of 40 cm. In the course of this passage, the temperature of the filament bundle rises to 159° C., measured in a contact-free manner with a KT 15 radiation thermometer (manufacturer: Heimann GmbH, Wiesbaden, West Germany). The dwell time of the filaments of the calender rolls is about 10 seconds. The calender rolls unit is equipped with an exhaust for removing residual solvent.

The warm acrylic tow, which has a linear density of 344,000 dtex, still has a residual solvent (DMF) content of 0.8% by weight. The tow can then be stretched, crimped, shrunk and cut into staple fibres in one uninterrupted operation.

We claim:

1. A dry-spinning process for preparing polyacrylonitrile filaments which contain at least 45% by weight of acrylonitrile units and have a residual solvent content of less than 5% by weight in a total linear density of over 100,000 dtex without contact with an extracting agent for the spinning solvent, characterized in that:

(a) the spinning solution spun has a viscosity at 100° C. of 10 to 60 falling-ball seconds, (b) the filaments are treated while still hot, directly at the end of the spinning cell, inside it or immediately outside the end of the spinning cell, with a spin-finish which contains a lubricant and an antistat and which gives the filaments a moisture content of at most 10% by weight, relative to the solids content of the fiber, and (c) the filaments are immediately exposed to heat treatment without cooling down first, said process further characterized in that the filaments are continuously dry-spun, the so spun filaments are while still hot continuously treated with said spin-finish and the resultant so treated filaments are continuously immediately exposed to a heat treatment without cooling down first.

2. Process according to claim 1, characterised in that the draw-down is greater than 2 and the spinning solution has a viscosity at 100° C. of 15 to 50 falling-ball seconds.

3. Process according to claim 1, characterised in that the polyacrylonitrile filaments consist of acrylonitrile copolymers which contain at least 85% by weight of acrylonitrile units.

* * * * *

UNITED STATES PATENT AND TRADEMARK OFFICE

CERTIFICATE OF CORRECTION

PATENT NO. : 4,505,870

DATED : March 19, 1985

INVENTOR(S) : Ulrich Reinehr, et al

It is certified that error appears in the above-identified patent and that said Letters Patent is hereby corrected as shown below:

The term of this patent subsequent to April 2, 2002, has been disclaimed.

Signed and Sealed this

*Tenth* Day of *September 1985*

[SEAL]

*Attest:*

DONALD J. QUIGG

*Attesting Officer* *Acting Commissioner of Patents and Trademarks - Designate*